US008910865B2

(12) United States Patent
Coomer et al.

(10) Patent No.: US 8,910,865 B2
(45) Date of Patent: Dec. 16, 2014

(54) BALLOT LEVEL SECURITY FEATURES FOR OPTICAL SCAN VOTING MACHINE CAPABLE OF BALLOT IMAGE PROCESSING, SECURE BALLOT PRINTING, AND BALLOT LAYOUT AUTHENTICATION AND VERIFICATION

(75) Inventors: Eric Coomer, Broomfield, CO (US); Larry Korb, Moraga, CA (US); Brian Glenn Lierman, Exeter, CA (US)

(73) Assignee: Dominion Voting Systems, Inc., Denver, CO (US)

( * ) Notice: Subject to any disclaimer, the term of this patent is extended or adjusted under 35 U.S.C. 154(b) by 0 days.

(21) Appl. No.: 13/092,599

(22) Filed: Apr. 22, 2011

(65) Prior Publication Data

US 2012/0145784 A1 Jun. 14, 2012

Related U.S. Application Data

(63) Continuation of application No. PCT/US2009/061343, filed on Oct. 20, 2009.

(60) Provisional application No. 61/193,062, filed on Oct. 24, 2008.

(51) Int. Cl.
*G07C 13/00* (2006.01)

(52) U.S. Cl.
CPC ..... *G07C 13/00* (2013.01)
USPC ..... 235/386

(58) Field of Classification Search
USPC ..... 235/386
See application file for complete search history.

(56) References Cited

U.S. PATENT DOCUMENTS

| | | | | |
|---|---|---|---|---|
| 3,542,287 | A * | 11/1970 | Margaretos et al. | 235/386 |
| 7,306,148 | B1 * | 12/2007 | Morganstein | 235/386 |
| 2005/0052519 | A1 * | 3/2005 | Mayer et al. | 347/105 |
| 2006/0081706 | A1 * | 4/2006 | Onischuk | 235/386 |
| 2007/0170253 | A1 * | 7/2007 | Chung et al. | 235/386 |
| 2008/0093455 | A1 * | 4/2008 | Barten | 235/454 |
| 2008/0110985 | A1 * | 5/2008 | Cohen et al. | 235/386 |

* cited by examiner

*Primary Examiner* — Thien M Le
*Assistant Examiner* — Toan Ly
(74) *Attorney, Agent, or Firm* — Holland & Hart LLP

(57) ABSTRACT

A ballot authentication system uses a plurality of security features embedded in and/or printed on the paper stock used to print a ballot on which election-choice-information is printed and a voting unit that includes at least a scanner that is configured to detect the plurality of security features that are embedded in and/or printed on the ballot and authenticate the ballot based on the read information. The voting unit of the ballot authentication system can be configured to verify and confirm that the various security features embedded in and/or printed on the ballot is correct for a particular precinct of an election. The security features of the ballot authentication system can include static, dynamic and data security features.

11 Claims, 5 Drawing Sheets

BALLOT LEVEL SECURITY FEATURES FOR OPTICAL SCAN VOTING MACHINE CAPABLE OF BALLOT IMAGE PROCESSING, SECURE BALLOT PRINTING, AND BALLOT LAYOUT AUTHENTICATION AND VERIFICATION

This application claims the benefit of U.S. Provisional Application No. 61/193,062 filed Oct. 24, 2008. The disclosure of U.S. Provisional Application No. 61/193,062 is incorporated herein by reference in its entirety.

BACKGROUND

The improvements described herein relate to technologies for secure ballot image processing, ballot printing, and ballot layout authentication and verification.

Of great importance in maintaining the integrity of the voting process is ensuring that only authentic ballots are used during an election. In addition, due to the disconnected nature of optical scan based voting systems (in which an optical scanner is used to interpret voter intent and tabulate paper ballots that were previously filled-out by voters), it is imperative that the system can identify and verify that the content of the printed ballot matches the electronic definition that the system uses to interpret and process the ballot. In this regard, it is desirable to develop a ballot that includes certain security features to deter unauthorized printing, copying or counterfeiting of the ballot, as well as secure identifying information for the ballot layout.

SUMMARY

In view of the above issues, a number of improvements are presented.

Some improvements relate to layered security features for ballots and to a ballot authentication system for both precinct and central optical ballot scanners. Particularly, improvements relate to the variable combination of latent security features in every ballot. The security features can be readable by embedded sensors in the optical ballot scanners. Such features prevent unauthorized, duplicated, and/or counterfeit ballots from being counted as valid ballots. Further, these features ensure the ability to track a ballot from generation to tabulation, thereby ensuring a secure chain of custody from beginning to end, and the ability to fully audit the life cycle of a given ballot. Finally, invalid ballots can be clearly marked utilizing an integrated ballot imprinter to clearly identify counterfeit, duplicated, or unauthorized ballots.

Some improvements provide a secure system for the production, printing, inspection, and authentication of ballots used in an election. Further, such improvements can prevent the unauthorized generation, printing, duplication, or counterfeiting of ballots for use in an election.

Some improvements relate to a ballot layout authentication system for precinct and central optical ballot scanners. Particularly, such improvements relate to authentication features that help to guarantee that a printed ballot matches the electronic definition of the ballot used by the optical ballot scanners to process and interpret the voter marks on the paper ballot Some improvements provide a validation mechanism for verifying that the electronic definition of the ballot layout matches the physical printed ballot. This validation mechanism will ensure that the disparate definitions are in sync and thus will ensure the integrity of the ballot interpretation, and correct tally and tabulation of the voter-marked ballots.

Ballots, such as paper ballots, on which election choice information is printed (that is, one or more items for which a voter is to cast his/her vote (the items can request a voter to choose/select a candidate for a particular office and/or request the voter to vote for or against a proposal/referendum, etc.)) contain one or more security features to be described in more detail below.

A ballot authentication system can include the above-mentioned ballots and a voting unit that processes the ballots. The ballots can include a plurality of security features that are embedded in paper stock used to print the ballots. A plurality of security features also can be printed on each ballot during the process of printing the ballot. The voting unit can include at least an optical ballot scanner that is capable of detecting and verifying the plurality of security features embedded in the paper stock used to print the ballot and the plurality of security features printed on the ballot during the process of printing the ballot. The voting unit can be configured to verify and confirm (authenticate) the various security features embedded in and printed on the ballots.

The security features can include, static, dynamic and data security features.

The security features can include at least one of ultraviolet features, infra-red features, magnetic features, fluorescent features, visual ink features and watermarks.

The data security features can include at least one of plain and encrypted data.

At least some of the security features may be masked by one another. For example, a printed security feature can be printed on the ballot over a security feature that is embedded in the paper stock used to make the ballot.

A further aspect provides a method of validating and authenticating a ballot. The method includes calculating a unique authentication value based on election information provided on the ballot (such as the given set of contests and candidates positioned on the ballot), printing the unique authentication value on the ballot, providing an optical ballot scanner that is configured to receive ballots having the authentication value printed thereon, comparing the authentication value provided on the ballot (as scanned by the optical scanner) with an authentication value stored by the optical ballot scanner, and marking the ballot as invalid if the scanned authentication value does not match the authentication value stored by the optical ballot scanner.

Another aspect provides a method for authenticating ballots used in an election having multiple precincts. The method includes (i) providing a plurality of ballots on which election-choice-information is printed, the ballots having a plurality of security features; (ii) providing, from among the plurality of ballots, a first set of ballots having a first set of the plurality of security features in each ballot; (iii) assigning the first set of ballots to a first precinct; (iv) providing, from among the plurality of ballots, a second set of ballots having a second set of the plurality of security features in each ballot, the second set of security features being different from the first set of security features; (v) assigning the second set of ballots to a second precinct that is different from the first precinct; (vi) confirming, after a vote has been cast, whether a particular ballot has the first set of security features or the second set of security features and whether the particular ballot was cast in the first precinct or the second precinct; and (vii) marking the particular ballot as invalid if the particular ballot does not have the set of security features from the precinct in which the ballot was cast.

BRIEF DESCRIPTION OF THE DRAWINGS

The foregoing and further objects, features and advantages of the invention will become apparent from the following descriptions of exemplary embodiments with reference to the accompanying drawings, in which like numerals are used to represent like elements and wherein.

DETAILED DESCRIPTION OF EMBODIMENTS

Latent Security Features

Figure 1:
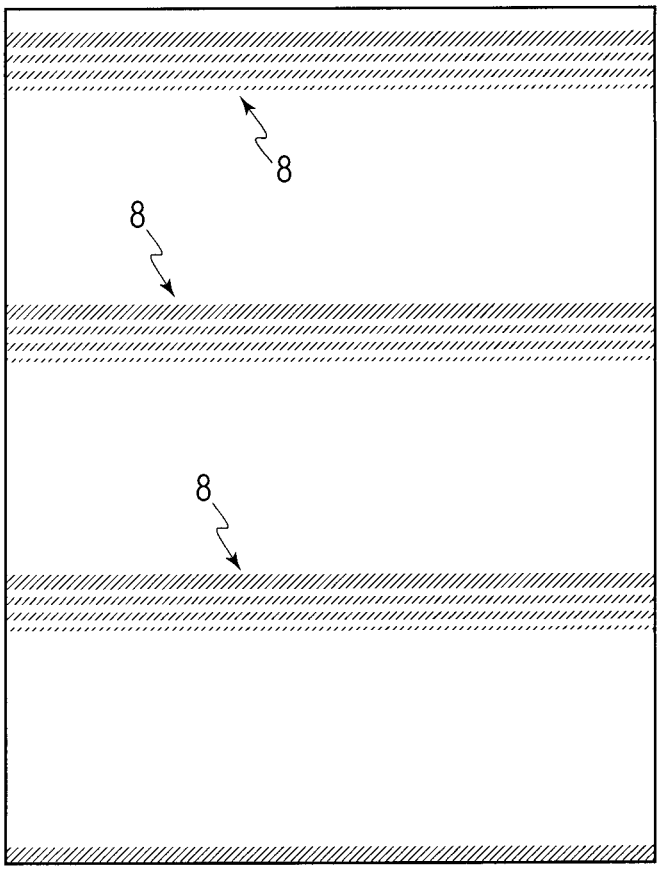
FIGS. 1 and 2 are diagrams illustrating examples of ballot security features.
Figure 2:
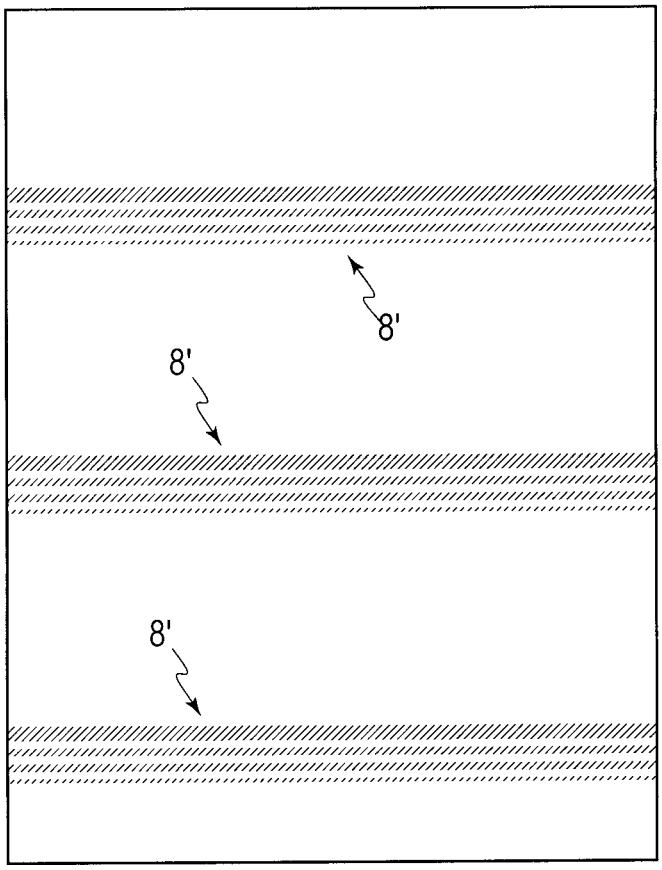

FIGS. 1 and 2 illustrate an example of a paper stock having security features included therein. FIG. 1 shows a plurality of security features 8 that are embedded in the paper stock used to print official ballots. Such security features 8 could include, but are not limited to: ultraviolet features; infra-red features; magnetic features; fluorescence features; visual ink features; and watermarks. It is known to incorporate similar features in, for example, paper currencies. The implementation of such features in paper stock used to print official ballots can include, but is not limited to: shapes, words; numbers; images; 1-D and 2-D barcodes; codes; and barcodes that can include any one of real data and encrypted real data. For example, if the embedded feature is magnetic (such as an embedded metallic layer) the embedded magnetic material can have a particular shape, including the shape of a number, letter or word, or could be in the form of a barcode. Further, the security features embedded in the paper stock can include pre-assigned security codes from a pre-assigned set of codes. On example of a pre-printed security code would be encoding an "expiration" date on the paper. Using a simple 1-D barcode, a numeric expiration date can be encoded on the paper using any of the latent features previously described. The ballot tabulator system can then be configured to reject paper with an expired code. Another example would be to encode a unique code, again utilizing a simple 1-D barcode pattern that must match the code assigned to the tabulator.

Figure 5:
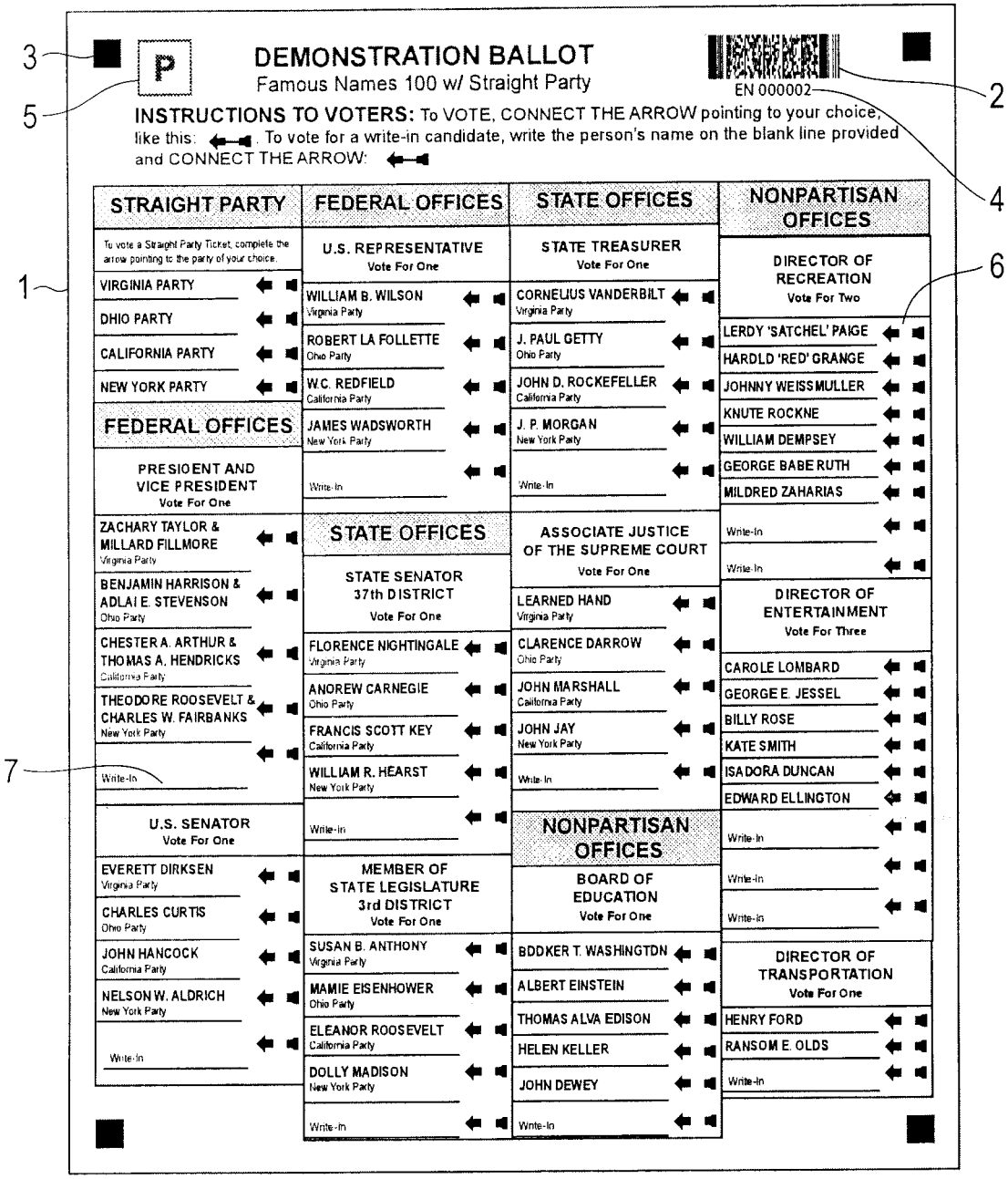
FIG. 5 is a diagram illustrating an example of a ballot.

In addition to the security features being embedded in the ballot paper stock, FIG. 2 shows security features 8' that can be printed on the ballot during the process of printing the official ballots (that is, during the process of printing the election choice information, an example of which is shown in FIG. 5, on the ballot). Such security feature properties can include, but are not limited to: ultraviolet features; infra-red features; magnetic features; fluorescence features; and visual ink features. The implementation of such features printed on the official ballots could include, but are not limited to: shapes; words; numbers; images; and 1-D and 2-D barcodes, Further, the numbers, codes, and barcodes can include any one of real data and encrypted real data. Furthermore, the security features printed on the ballot during the process of printing official ballots can include pre-assigned security codes from a pre-assigned set of codes as well as pre-assigned ballot serial numbers from a pre-assigned set of serial numbers.

As shown in FIGS. 1 and 2, the ballot security features can consist of, for example, a 1 inch series of bars 8 or 8' that are repeated every 3.5 inches along the length of the ballot.

In some examples, a supplier may be a licensed authorized supplier of secure paper stock for ballot printing. By only allowing licensed paper suppliers to control and restrict access to the paper stock, the paper is not available to someone trying to forge ballots. It is understood that a ballot is provided by printing election choice information shown in FIG. 5, for example, on the paper stock of FIG. 1 or FIG. 2. The printed security features 8' of FIG. 2 can be printed separately from or at the same time that the election choice information is printed. It is preferred that embedded and printed security features be used.

Figure 3:
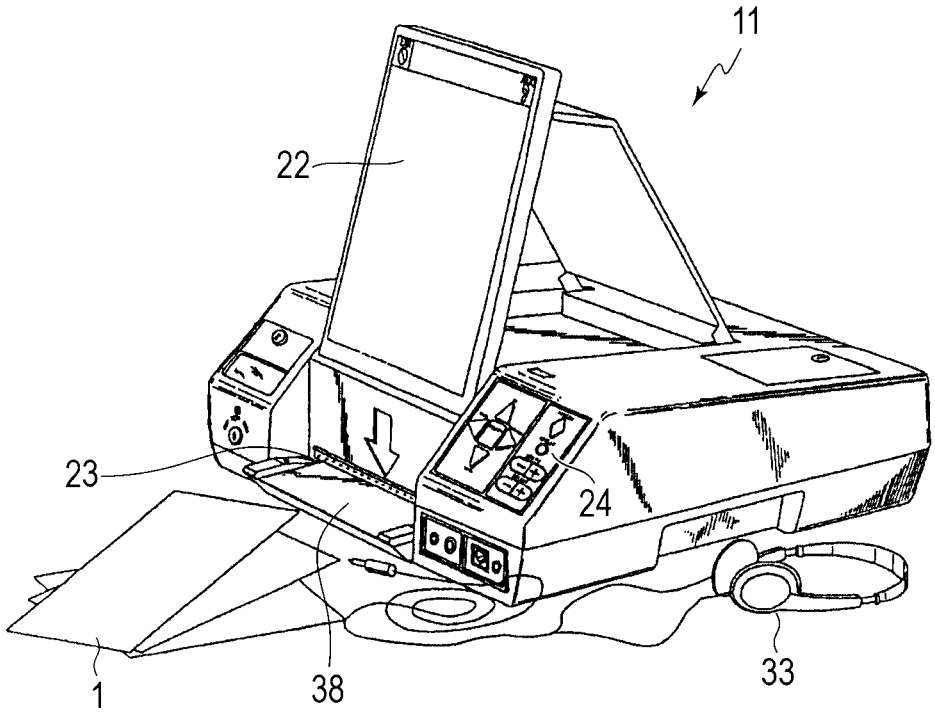
FIG. 3 is a diagram illustrating an example of a voting unit.
Figure 4:
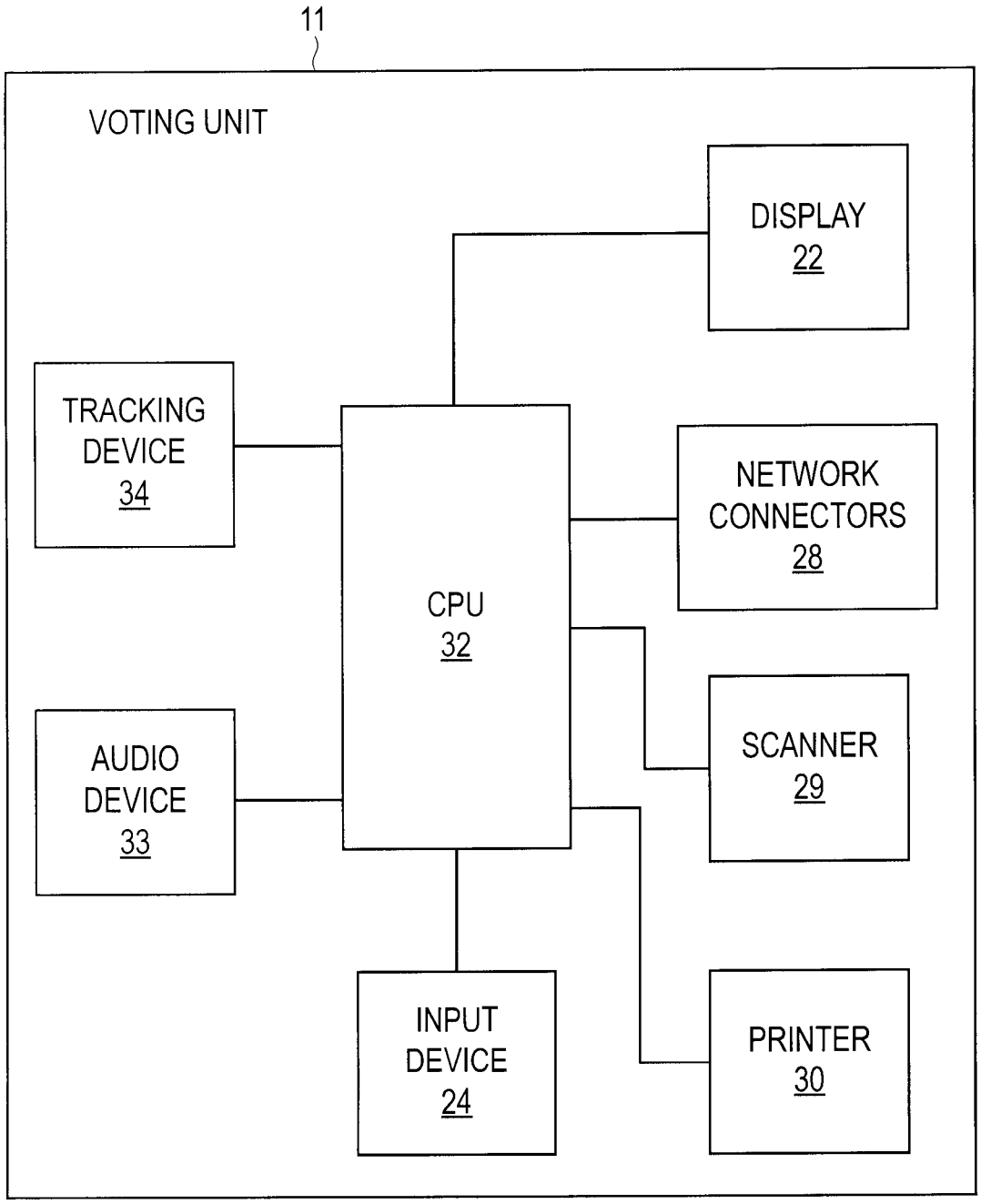
FIG. 4 is a diagram illustrating some of the components of a voting unit.

FIG. 3 illustrates an example of a voting unit 11 that includes an optical ballot scanner 29 (see FIG. 4). As seen from FIG. 3, voting unit 11 can include an input slot 23 into which a ballot 1 to be scanned is fed, a ballot feed tray 38, a display 22, an audio device 33 (having speakers), and a user-manipulatable input device 24. FIG. 4 illustrates some of the components that can be included in each voting unit 11. The voting unit 11 can include a CPU 32 that controls operation of the unit 11 including the functions described herein, a tracking device 34, an audio device 33, an input device 24, an optical scanner 29, a printer 30, network connectors 28 and a visual display unit 22. Voting unit 11 is not limited to these specific components as any number of other components known to one of ordinary skill in the art could be incorporated therein.

After a voter fills-in a ballot, the voter inserts the completed ballot into the slot 23 of the voting unit 11. The voting unit 11 then optically scans the ballot with its internal scanner 29, which can be a CCD scanner, for example. An image of the scanned ballot then can appear on the display 22. By viewing the image, the voter can confirm that the ballot image is correct. In addition, by using image recognition technology (see, for example, U.S. Pat. No. 6,854,644 to Bolton et al., the disclosure of which is incorporated herein by reference in its entirety), the voting unit 11 determines the selections made by the voter on the ballot (i.e., determines which candidates, etc. were selected by the voter) and displays those determined selections to the voter via display 22. The user can then confirm that the voting unit's determinations are correct. Once confirmed, the voting unit's determinations are stored in memory for future tabulation. The ballot 1 also is stored in the voting unit 11.

The voting unit 11 also is capable of detecting and verifying a plurality of security features embedded in the paper stock used to print official ballots. Additionally, if the security features include data (plain or encrypted), the voting unit 11 is capable of interpreting the data and verifying it. Further, if the security features include pre-assigned security codes, the voting unit II, for example using its scanner 29, is able to verify that the security codes present are authorized for that election. The necessary sensors to detect these latent features are included in the voting unit 11. These sensors consist of, but are not limited to, the following: Ultra-violet LED and sensor, Infra-red LED and sensor, magnetic sensor and the necessary electronics and software in order to decode the detected signals.

FIG. 5 illustrates an example of a ballot 1 before the ballot has been filled out by a voter where voting marks can consist of, for example, separated ends of an arrow 6 that the voter can connect to cast a vote for a particular candidate. The ballot 1 can be, for example, 4.25 inches or 8.5 inches wide and from 11 inches to 22 inches in length. In one embodiment illustrated in FIG. 5, the ballot registration marks 3 are solid black 0.25 inch squares located just inside of a 0.25 inch unprinted area, bounding all sides of the ballot 1. Where the ballot 1 is longer than 11 inches, additional registration marks are desirable. The ballot can also include 'write in' areas 7, a machine-readable barcode 2 and a human readable version 4 of the machine-readable barcode 2 printed below the machine readable barcode 2

As noted earlier, the voting unit 11 additionally is capable of detecting and verifying a plurality of security features embedded in the printer stock and/or printed on the ballot 1 during the process of printing official ballots. In the case where the security features include data (plain or encrypted), the optical scanner 29 is capable of interpreting the data and verifying it. Further, if the security features printed on the ballot 1 include a pre-assigned ballot serial number, the optical scanner 29 will be able to verify that the serial number present is authorized for that election and has not already been processed.

The features specifically mentioned above can include but are not limited to:

Ultraviolet features—These are features that are invisible when viewed under normal white light but become visible when illuminated by Ultra-violet light sources. They can also be features that absorb ultra-violet light. Typically these are inks Infra-red features—These are features that are invisible when viewed under normal white light but become visible when illuminated by Infra-red light sources. They can also be features that absorb infra-red light. Typically these are inks Magnetic features—These are features that have specific magnetic properties. Typically they are strips of magnetic material embedded in the paper, however magnetic inks also are available. The magnetic properties can be simple such as a uniform magnetic property or complex, such as a strip of material that has varying magnetic intensities along it which can represent a pattern or data.

Fluorescent Features—These are features that may be visible or invisible when viewed under normal white light and fluoresce with an expected intensity range when illuminated by certain frequencies of light. Typically these are inks Visual ink features—These are features that are visible under normal light.

Watermarks—Watermarks are typically physical features which are imprinted into the paper, either by embedding the layers within the paper or by being embossed into the paper. They are typically visible in normal white light but can not be replicated by printing techniques. (Note: Watermarks can also be Ultra-violet, Infra-red, fluorescent or magnetic features)

A number of security features can be used in conjunction with each other to further improve security and make the forging or copying of ballots even more difficult The voting unit 11 includes one or more scanners (detectors) that are capable of detecting and reading the expected security features on the ballot 1. Such detectors are known to be used in currency authenticating apparatus. The definition of which security features to look for will form part of the ballot definition for the voting unit 11 so that the security features can be varied between jurisdictions, elections,-and even precincts. That is, a set of security features can be assigned to the ballots of each precinct, jurisdiction, election, etc., and the members of the set can be changed for different precincts, jurisdictions and elections, etc. One example of a combined set of security features would be the existence of UV fluorescent features, alternating with Infra-red features pre-printed on the ballot. These features would be detected with both a UV sensitive and IR sensitive sensor on the voting unit 11. These could also be combined with a human detectable water-mark. This water-mark can also be detected and processed by the optical scanner provided in the voting unit 11.

The security features described above can be used such that they are grouped into three basic groups: static; dynamic; and data. Almost all of the types of features (UV, IR, magnetic, etc.) could belong to any of the groupings, depending on the implementation of the specific security features.

The group of static features refers to the situation where the feature is placed in the paper stock and is looked for by the voting unit 11. These static features do not contain data and thus the security features solely consist of the presence (or absence) of the feature. Typically, static features can, for example, consist of a mark in a set position or area on the ballot such that the positioning of the static feature does not change. Typically, features are static because they are expensive to alter. For example, embedding magnetic strips in paper stock is a relatively expensive process. Therefore, it is likely that such features will be incorporated in a large volume of stock at one time and not altered frequently, if at all. Other static features may be selected because of the particular process that is used to create them. For example, a simple ink (such as UV or IR) feature could be applied during the paper stock manufacture process via a roller or brush. Such an application is relatively difficult to alter so again would be applied to large batches. Watermarks are another example of a security feature that is normally static.

Dynamic features refer to features that can be varied, either in position, size, shape or content. Typically, features that are relatively cheap and easy to vary will be used as dynamic security features. For example, a feature which is somehow printed onto the stock during the manufacture process, such as a secure ink feature (using UV or IR sensitive) is often a dynamic feature. As it is printed at the time of manufacture, the position, shape and other properties could be altered for different batches of paper stock. Therefore, the dynamic security features can easily be varied for different elections, jurisdictions, or even districts to provide added security and prevent counterfeiting of ballots. Further, the voting unit 11 can be programmed to detect the specific feature, shape and location expected for the given election and jurisdiction.

Data features are a special group of dynamic features. They contain data that can be read and verified by, for example, the scanner 29 of voting unit 11. Typically, the data will be represented in a feature such as a 1-D or 2-D bar code. While the data could be anything, it is preferably a security code that can be validated. This data can be easily varied for different elections, jurisdictions, or even districts. To further increase the security of the code, the data can be encrypted using a pre-agreed private-public key pair. Thus, even if a potential forger managed to create some paper with the necessary feature technology (for example UV ink) and could reproduce the type of feature (say a barcode), the forger would have to know the correct security code to represent for that election. If the codes are encrypted, a scheme can be utilized that would require the forger to also have the public and private keys generated by the jurisdiction.

Printed features, such as those using ultra-violet, infra-red, fluorescent, or magnetic ink could also be applied to each ballot by the ballot printer (the printer used to print a ballot such as the ballot shown in FIG. 5). This represents a different type of security as the 'source' of the security feature is not controlled; however, the content is and can be varied at a much lower level of granularity. For example each ballot style could have a printed security feature that has an encrypted code representing the election and ballot style along with the precincts in which they are valid. These security features could then be detected and verified by the scanner 29 of the voting unit 11. This improvement gives a very fine level of control and security to the ballot authentication process.

The security features may also be masked by each other. For example, a feature that is printed using normal visible ink could have a different UV or IR feature printed on top of it. Further, if paper stock and ballot printer features are combined, it becomes virtually impossible—and certainly prohibitively expensive—to try to copy or forge ballots.

Ballot Layout Authentication

This improvement also includes a suitable procedure for calculating a unique value for a given set of contests and candidates positioned on a ballot 1. This value is included in a printable format in the image used to print the physical paper ballots 1. While the value may, or may not be human readable, the value is machine readable by the scanner 29 of voting unit 11. When the scanner 29 is programmed for use with a given ballot 1 (that is, for a given election), the unique layout value is included in the ballot definition. During the processing of the physical ballots, the value imprinted on the paper ballot 1 is compared to the value associated with the ballot definition on the scanner 29. If the values do not match, the scanner 29 will reject the ballot without further processing, or otherwise mark the ballot (via printer 30) as invalid. One possible implementation will be a hash calculation of the various candidate IDs and the associated target locations on the ballot face. However, there are a plurality of methods that can be employed to create a unique signature of the candidates and positions associated with all of the targets on the ballot face. By encoding this value on the ballot 1 itself, and then calculating the value again based on the electronic ballot definition used by the scanner 29 to process the ballot 1, the system can ensure the processing will match the physical layout of the ballot 1.

Each voting unit 11 is provided a "ballot definition" of each ballot face valid for the voting unit 11 which includes the candidate ID and location (in x,y coordinates relative to the registration mark) of each votable target on the page. The concatenated list of these data points can generate a unique value (Hash) using a standard hash algorithm (SHA-1, SHA-256). Each unique ballot face will generate a unique hash value when computed using the candidate/target position information. Once a ballot is scanned and the voting unit 11 assigns the correct ballot definition based on the ballot identifier, the unique hash signature can be recalculated using the ballot definition in order to compare to the value encoded on the ballot. The hash value can also be pre-calculated when the ballot definitions are loaded onto the voting unit 11. Each ballot definition will include a calculated hash value. This value can then be compared to the value encoded on the scanned ballot.

In some examples, the fundamental ballot definition could be changed in an Election Management System (EMS) after the physical ballots have been printed. The scanner can then be initialized with the modified ballot layout definition. The modifications in the EMS/electronic ballot definition could include swapping the candidate positions between two candidates on the ballot as a way of altering the vote totals for a given contest.

To prohibit such an occurrence, the layout validation and authentication feature can be calculated during the production of the images used to print the ballots 1. This feature will be a unique encrypted or human readable feature that uniquely represents the position of the targets on the printed ballot 1 in addition to the candidate and contest information. This value will be printed on the ballot 1 in such a way that the scanner 29 can read this value and then compare it to the electronic definition of the ballot 1 to ensure that the values, and hence the ballot target layout, are identical.

The foregoing description is considered as illustrative only of the principles of the improvements discussed above. The inventions described herein are not limited to specific examples provided herein.

What is claimed is:

1. A method of validating and authenticating a voter-marked paper ballot, the method comprising:

calculating a unique authentication value based on election information provided on the voter-marked paper ballot;

printing the authentication value on the voter-marked paper ballot as an encrypted security code in a printed security feature, the authentication value encrypted using a private-public key pair;

associating the authentication value with a scanner that is configured to receive and scan ballots having been completed by voters;

scanning each voter-completed ballot to obtain the encrypted security code from the voter-marked paper ballot;

decrypting the encrypted security code using the private-public key pair to obtain the authentication value;

comparing the authentication value obtained from the ballot with the authentication value associated with the scanner; and physically marking the voter-marked paper ballot as invalid when the ballot-obtained authentication value does not match the authentication value associated with the scanner.

2. The method of claim 1, wherein the calculating a unique authentication value comprises performing a hash calculation of one or more candidate identifications and associated target locations on the ballot face.

3. The method of claim 2, wherein the hash calculation is performed using a concatenated list of data points representing coordinates of the one or more candidate identifications and associated target locations.

4. A method for authenticating ballots used in an election having multiple precincts, the method comprising:

providing a plurality of ballots on which election-choice-information is printed, the ballots having a plurality of security features, wherein the plurality of security features printed on the ballot during the process of printing official ballots include pre-assigned security codes from a pre-assigned set of codes and a pre-assigned ballot serial number from a pre-assigned set of serial numbers;

providing, from among the plurality of ballots, a first set of ballots having a first set of the plurality of security features associated with each ballot, the first set of security features including at least a first encrypted security code, the first encrypted security code comprising a first security code that is encrypted using a private-public key pair;

assigning the first set of ballots to a first precinct;

providing, from among the plurality of ballots, a second set of ballots having a second set of the plurality of security features associated with each ballot, the second set of security features being different from the first set of security features and including at least a second encrypted security code, the second encrypted security code comprising a second security code that is encrypted using the private-public key pair;

assigning the second set of ballots to a second precinct that is different from the first precinct;

determining, after a vote has been cast, whether a particular ballot has the first set of security features and first security code or the second set of security features and second security code and whether the particular ballot was cast in the first precinct or the second precinct; and physically marking the particular ballot as invalid when the particular ballot does not have the security features and security code from the precinct in which the particular ballot was cast.

5. The method of claim 4, wherein the first security code comprises a hash calculation of one or more candidate identifications and associated target location(s) on a first ballot face of ballots of the first set of ballots, and wherein the second security code comprises a hash calculation of one or more candidate identifications and associated target locations on a second ballot face of ballots of the second set of ballots.

6. The method of claim 5, wherein the hash calculations are based on concatenated list of data points representing coordinates of the one or more candidate identifications and associated target locations of the associated ballot faces.

7. A voting unit, comprising:

a memory;

a processor in communication with the memory, the processor controlling operations of the voting unit to:

scan a voter-marked paper ballot used in an election, the voter-marked paper ballot comprising a first and second security features, wherein the first security feature is embedded in the voter-marked paper ballot, and the second security feature includes an encrypted security code printed on the voter-marked paper ballot;

verify the first security feature by utilizing an electronic sensor to detect the first embedded security feature;

decrypt the second security feature by processing the encrypted security code with a private-public key; and authenticate the voter-marked paper ballot by comparing the verified first security feature and the decrypted second security feature with a set of pre-assigned first and second security features stored in the memory of the voting unit, wherein the voter-marked paper ballot is physically marked as invalid when the first and second security features do not match the set of pre-assigned first and second security features stored in the memory.

8. The voting unit of claim 7, wherein the pre-assigned first and second security features are assigned to the voter-marked paper ballots of each precinct, jurisdiction, or election.

9. The voting unit of claim 7, wherein the first security feature comprises a static feature, wherein verifying the first security feature comprises detecting the presence or absence of the first security feature.

10. The voting unit of claim 7, wherein the second security feature comprises an encrypted barcode.

11. The voting unit of claim 7, wherein at least some of the first and second security features overlap each other on the ballot.

* * * * *